US005833590A

United States Patent [19]

Chiu et al.

[11] Patent Number: 5,833,590

[45] Date of Patent: Nov. 10, 1998

[54] BACKBONE STRETCHING EXERCISER

[76] Inventors: Ching-Chih Chiu; Sheng-Yung Wu, both of 3th Fl., 4, Sublane 1, Lane 32, Tzu Li Street, Hsin Feng Hsiang, Hsinchu Hsien, Taiwan

[21] Appl. No.: 939,655

[22] Filed: Sep. 29, 1997

[51] Int. Cl.[6] ..... A63B 21/00; A63B 26/00; A63B 21/008

[52] U.S. Cl. ..... 482/142; 482/140; 482/130; 482/112; 482/133; 482/907

[58] Field of Search ..... 482/140, 142, 482/148, 132, 130, 133, 907, 95, 96, 112

[56] References Cited

U.S. PATENT DOCUMENTS

| | | | |
|---|---|---|---|
| 1,973,945 | 6/1934 | Chavin | 482/130 |
| 4,583,731 | 4/1986 | Crivello | 482/130 X |
| 5,070,863 | 12/1991 | McArthur | 482/142 X |
| 5,110,121 | 5/1992 | Foster | 482/142 X |
| 5,215,511 | 6/1993 | Cheng | 482/142 X |
| 5,256,126 | 10/1993 | Grotstein | 482/142 |
| 5,300,005 | 4/1994 | Wang | 482/142 |
| 5,531,658 | 7/1996 | L.S.C. | 482/142 |
| 5,559,261 | 9/1996 | Easley | 482/140 X |
| 5,573,485 | 11/1996 | Geshwender | 482/142 X |
| 5,624,361 | 4/1997 | Lai | 482/130 |
| 5,759,137 | 6/1998 | Huang | 482/142 X |

*Primary Examiner*—Michael A. Brown
*Assistant Examiner*—William LaMarca
*Attorney, Agent, or Firm*—Rosenberg, Klein & Bilker

[57] ABSTRACT

A backbone stretching exerciser including a base frame unit having two front lugs and two rear guide rollers respectively disposed at the top, a seat frame unit having a fixed end pivoted to front lugs of the base frame unit and a free end, a back frame unit pivoted to the free end of the seat frame unit and adapted for supporting the user's back, the back frame unit having two substantially arched guide tubes bilaterally disposed at a back side thereof and respectively supported on the guide rollers of the base frame unit, and a hydraulic cylinder connected between the base frame unit and the free end of the seat frame unit to impart a damping resistance to the seat frame unit.

6 Claims, 10 Drawing Sheets

BACKBONE STRETCHING EXERCISER

BACKGROUND OF THE INVENTION

The present invention to provide an exercising machines, and more specifically to a backbone stretching exerciser designed for stretching the backbone and exercising the muscles of the back.

When sitting on a chair for a certain length of time, one may feel uncomfortable and have to leave from the seat, permitting the backbone to be relaxed or gently exercised. Further, a variety of exercising machines are well known for exercising different parts of the body. However, there is no any exercising machine particularly designed for stretching the backbone.

SUMMARY OF THE INVENTION

It is one object of the present invention to provide a backbone stretching exerciser which is particularly designed for stretching the backbone. It is another object of the present invention to provide a backbone stretching exerciser which simultaneously massages the user's back when it is operated. It is still another object of the present invention to provide a backbone stretching exerciser which is equipped with chest developer for exercising the muscles of the chest and the hands.

DETAILED DESCRIPTION OF THE PREFERRED EMBODIMENT

Figure 1:
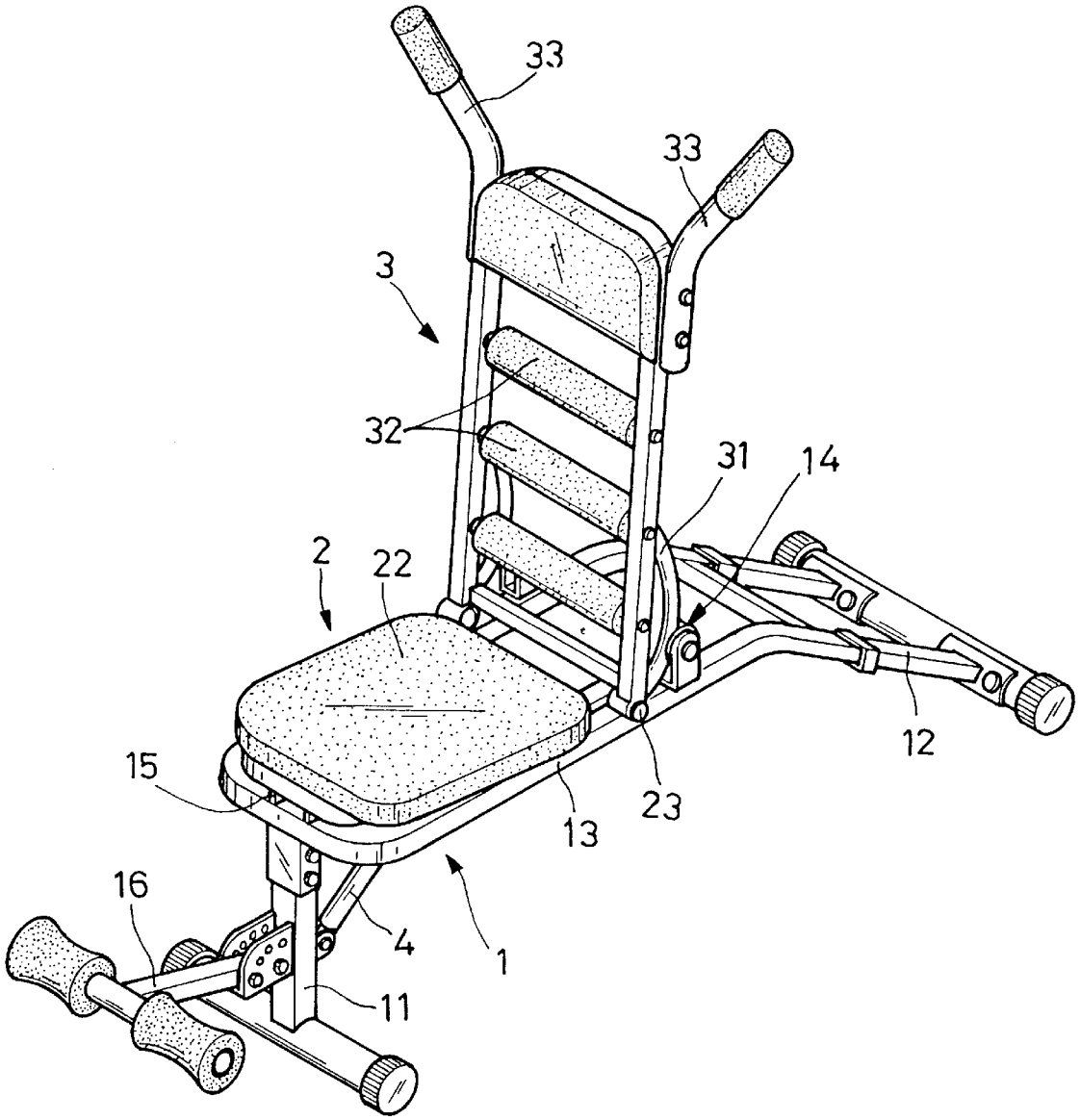
FIG. 1 is an elevational view of a backbone stretching exerciser according to one embodiment of the present invention.
Figure 2:
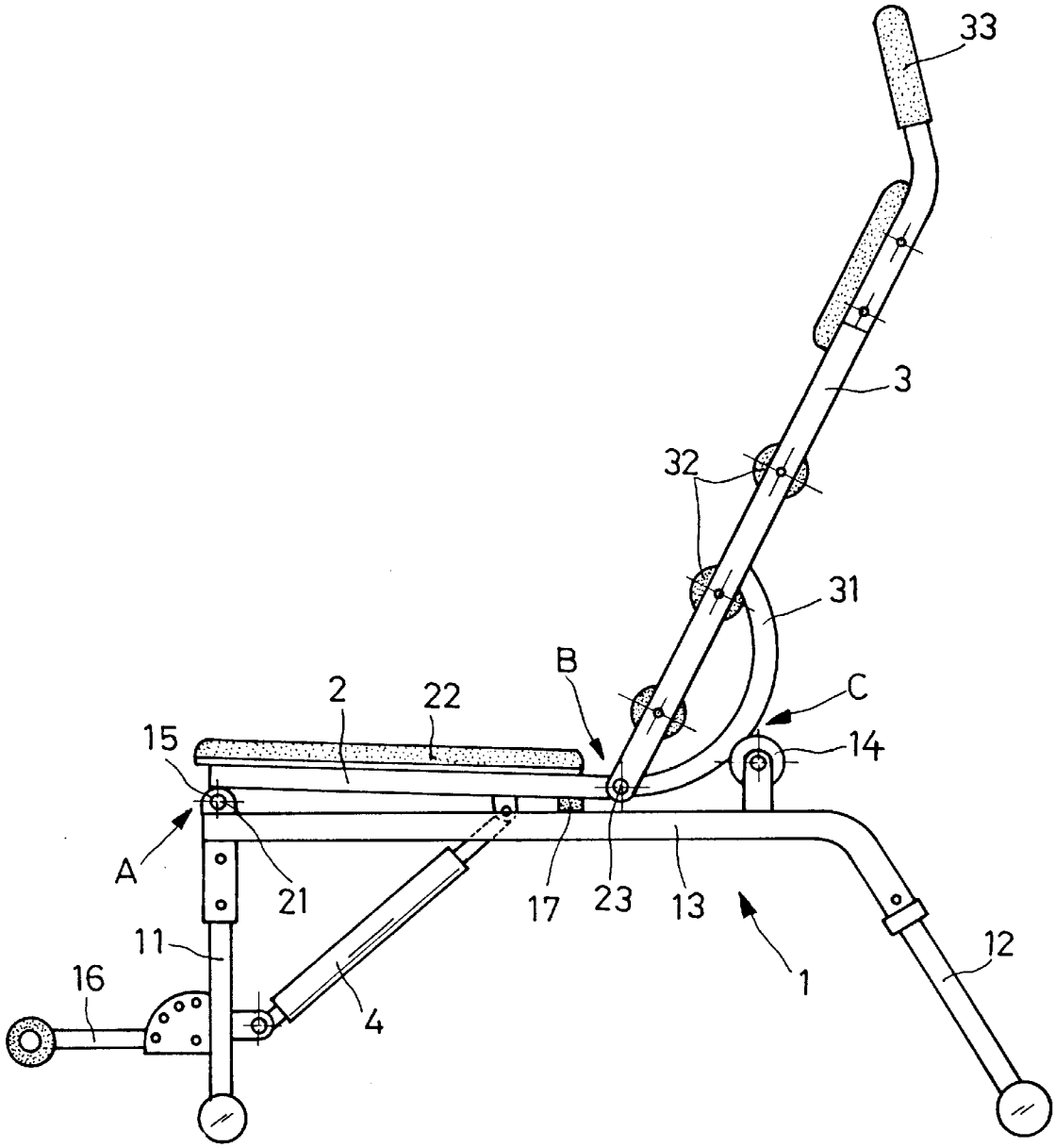
FIG. 2 is a side view of the backbone stretching exerciser shown in FIG. 1.
Figure 3:
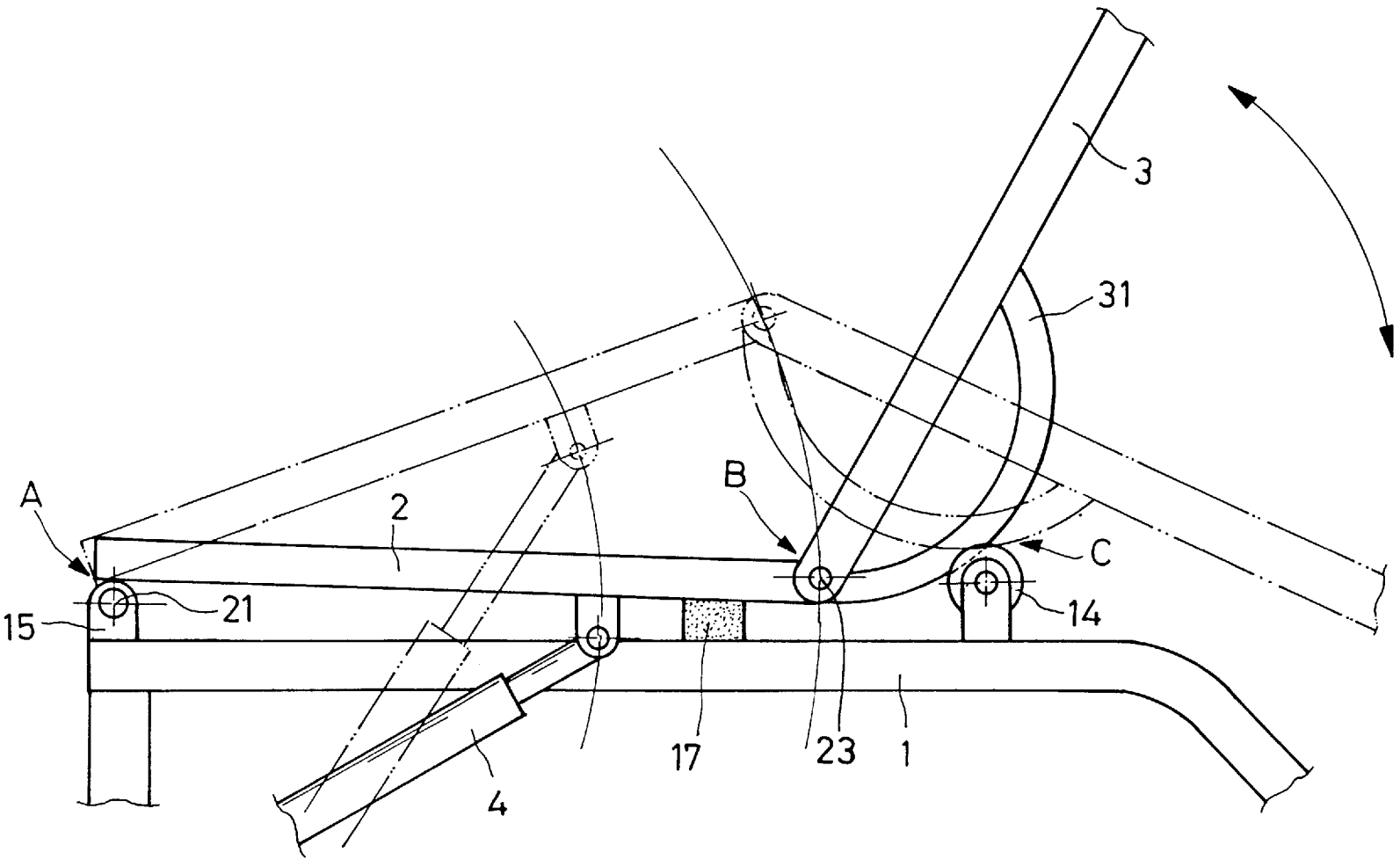
FIG. 3 is a schematic drawing of the present invention, showing the backbone stretching exerciser operated.

Referring to FIGS. from 1 to 3, a backbone stretching exerciser in accordance with the present invention is generally comprised of a base frame unit 1, a seat frame unit 2, a back frame unit 3, and a hydraulic cylinder 4.

The base frame unit 1 comprises a front stand 11, a rear stand 12, a horizontal top frame 13 supported on the front stand 11 and the rear stand 12, a pair of guide rollers 14 bilaterally mounted on the horizontal top frame 13 at the top adjacent the rear stand 12, a pair of lugs 15 bilaterally raised from the horizontal top frame 13 at the top adjacent the front stand 11, a substantially T-shaped leg extension bar 16 connected to the front stand 11, and a cushion 17 mounted on the horizontal top frame 13. The seat frame unit 2 holds a flexible seat 22, having its front end namely the fixed end A pivoted to the lugs 15 by pivot pins 21. The back frame unit 3 has a bottom end pivoted to two opposite sides of a rear end namely the free end B of the seat frame unit 2 by pivot pins 23, two substantially arched guide tubes 31 bilaterally disposed at its back side and respectively supported on the guide rollers 14 of the base frame unit 1, a plurality of cylindrical massaging wheels 32 transversely disposed in parallel and adapted for massaging the user's back, and two handles 33 bilaterally fastened to its top end remote from the seat frame unit 2. The connecting area between the arched guide tubes 31 and the guide rollers 14 form a slip joint C. The hydraulic cylinder 4 has a fixed end fixedly connected to the front stand 11 of the base frame unit 1, and a movable end (the piston) connected to the seat frame unit 2.

Referring to FIGS. from 2 and 3 again, when the backbone stretching exerciser is operated, the back frame unit 3 is alternatively turned up and down. When the back frame unit 3 is turned backwardly downwards, the free end B of the seat frame unit 2 is lifted to a higher place above the elevation of the guide rollers 14, therefore the user's backbone is bent backwards and stretched. On the contrary, when the back frame unit 3 is turned upwardly forwards, the free end B of the seat frame unit 2 is lowered to a lower plate below the elevation of the guide rollers 14 and supported on the cushion 17, and the user's back is supported on the supporting area W within the back frame unit 3 and massaged by the massaging wheels 32.

Figure 4:
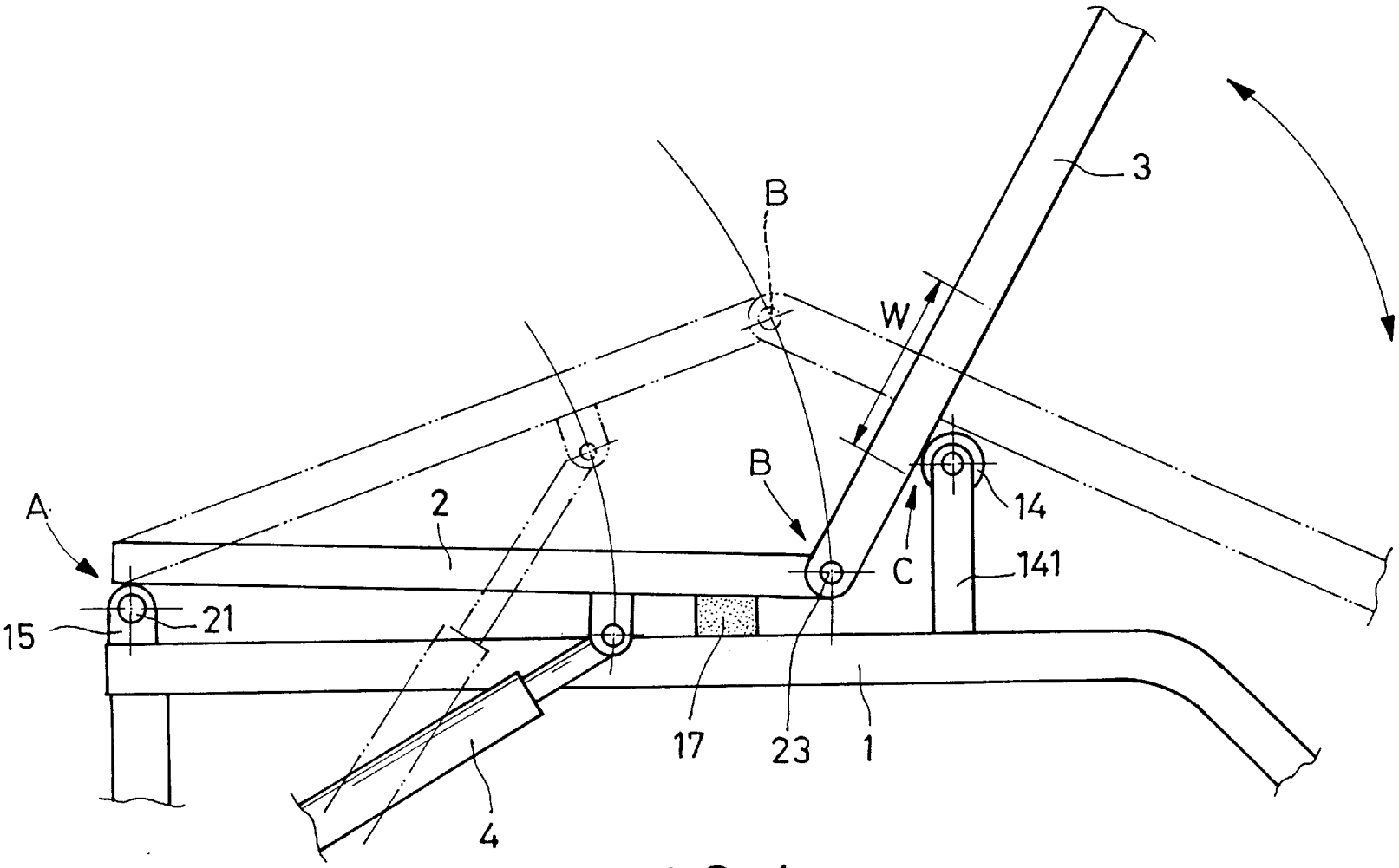
FIG. 4 is similar to FIG. 3 but showing the guide rollers respectively supported on an upright support, the back frame unit directly supported on the guide rollers.

FIG. 4 shows an alternate form of the present invention, in which the guide rollers 14 are supported on an upright support 141 at the top side of the base frame unit 1, and the back frame unit 3 is directly supported on the guide rollers 14. This alternate form eliminates the arched guide tubes 31 from the back frame unit 3.

Figure 5:
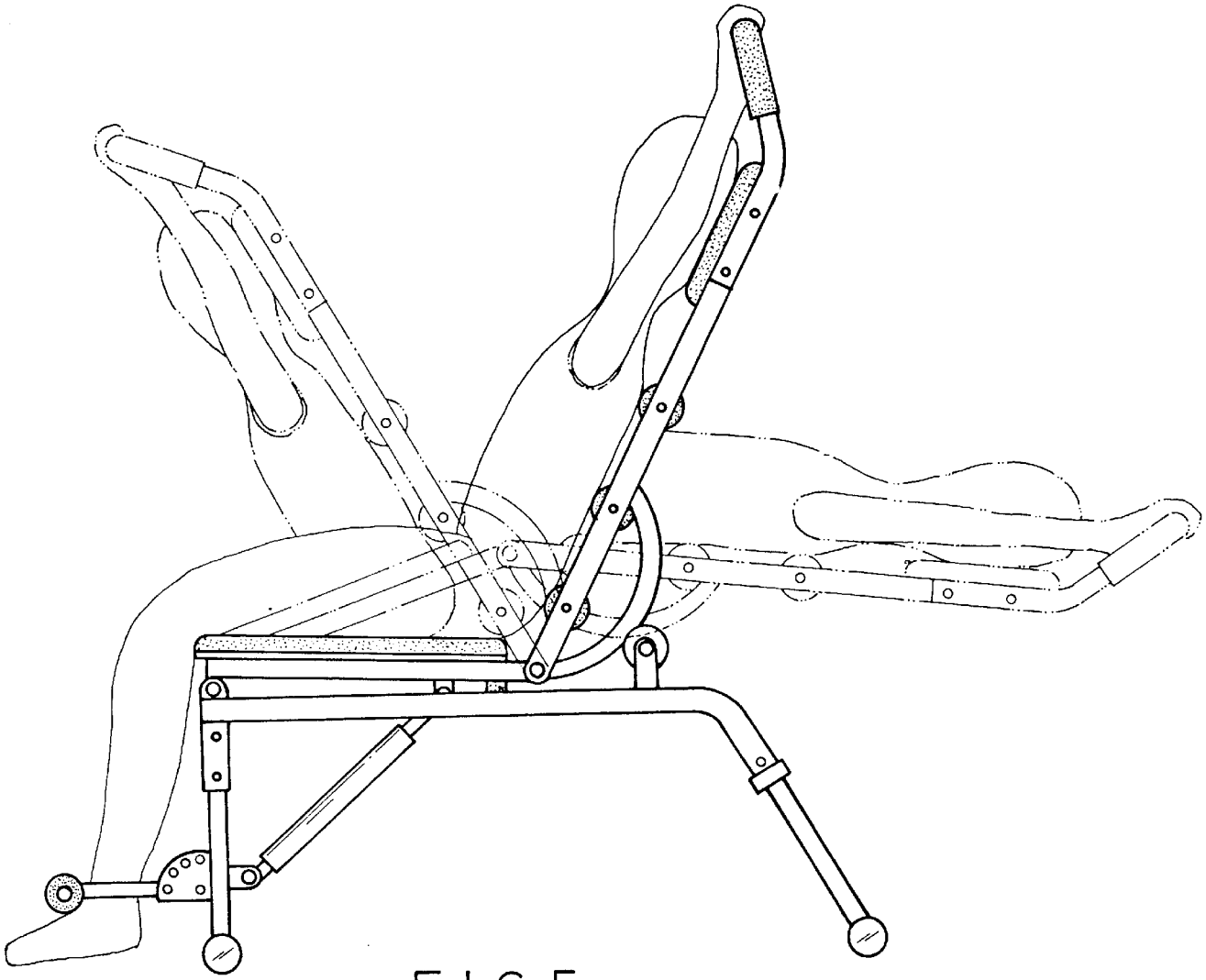
FIG. 5 is an applied view of the present invention, showing the user's backbone stretched and released.

Referring to FIG. 5 and FIG. 1 again, when the user sits on the flexible seat 22 with the legs hung on the leg extension bar 16 and the hands secured to the handles 33, the hands are moved downwardly forwards to turn the back frame unit 3 forwards and the body is bent forwards, then the body is relaxed, permitting the upper body to be bent backwards to stretch the backbone. When the back frame unit 3 is alternatively turned up and down, the back bone of the user is alternatively stretched and released, and at the same time the massaging wheels 32 massage the back of the user to stimulate the circulation of the blood.

Figure 6:
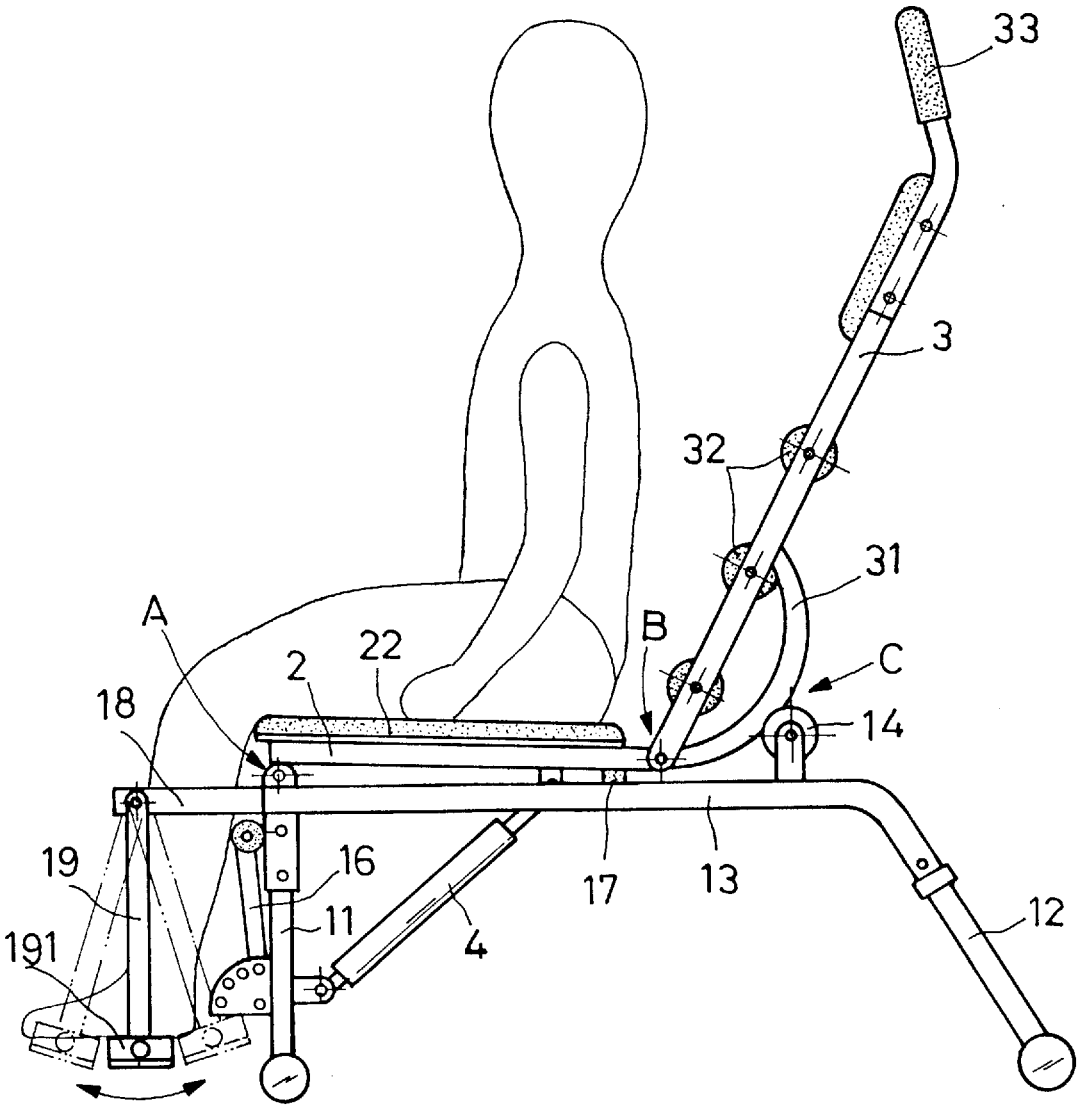
FIG. 6 is a side view of another alternate form of the present invention, showing the swinging bars oscillated.
Figure 7:
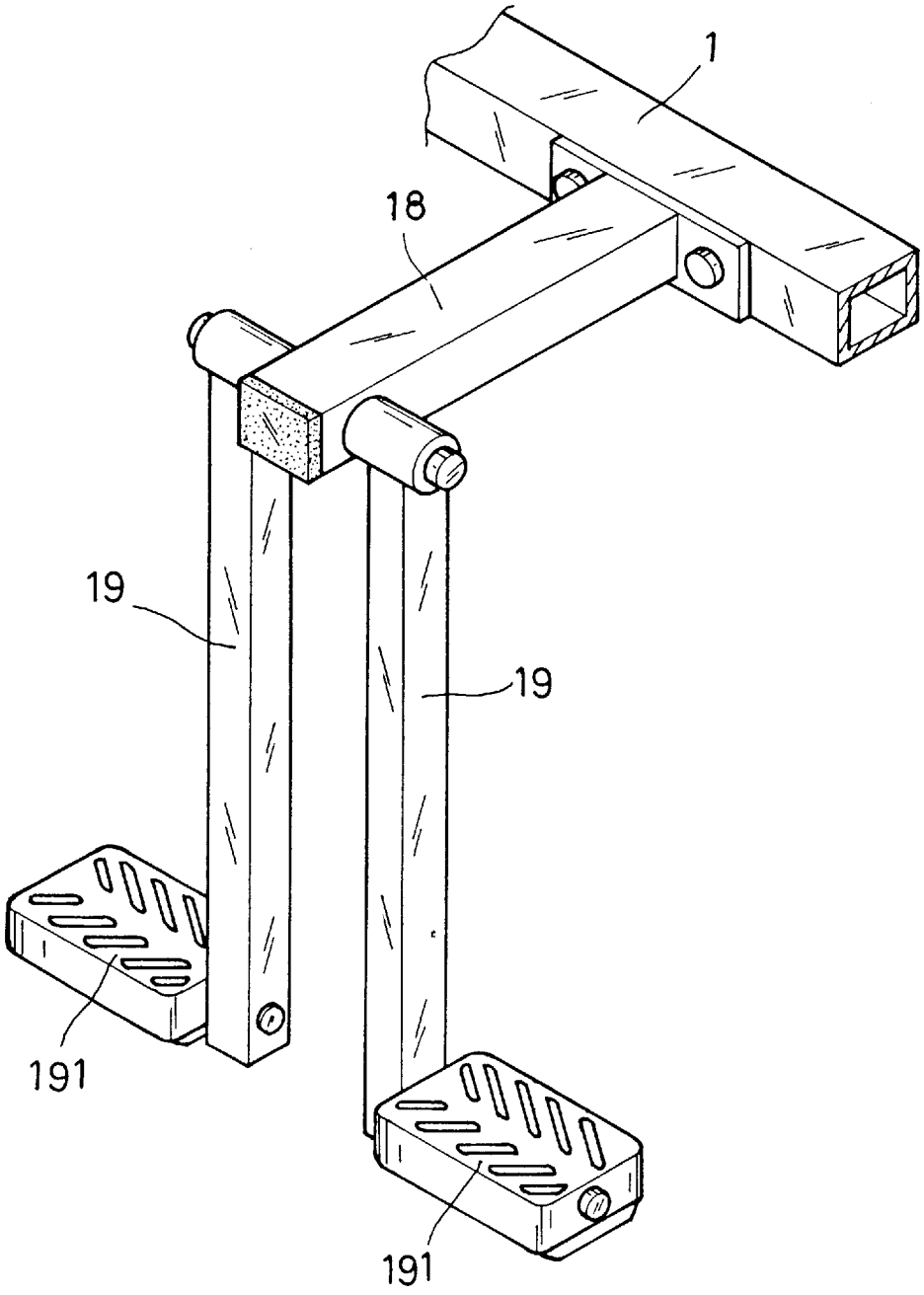
FIG. 7 is an elevational view of a part of the embodiment shown in FIG. 6, showing the swinging bars pivoted to the horizontal extension bar.

FIGS. 6 and 7 show another alternate form of the present invention, in which a horizontal extension bar 18 is connected to the front side of the horizontal top frame 13 to hold two swinging bars 19, each swinging bar 19 having a top end pivoted to the horizontal extension bar 18 and a bottom end mounted with a foot plate 191.

Figure 8:
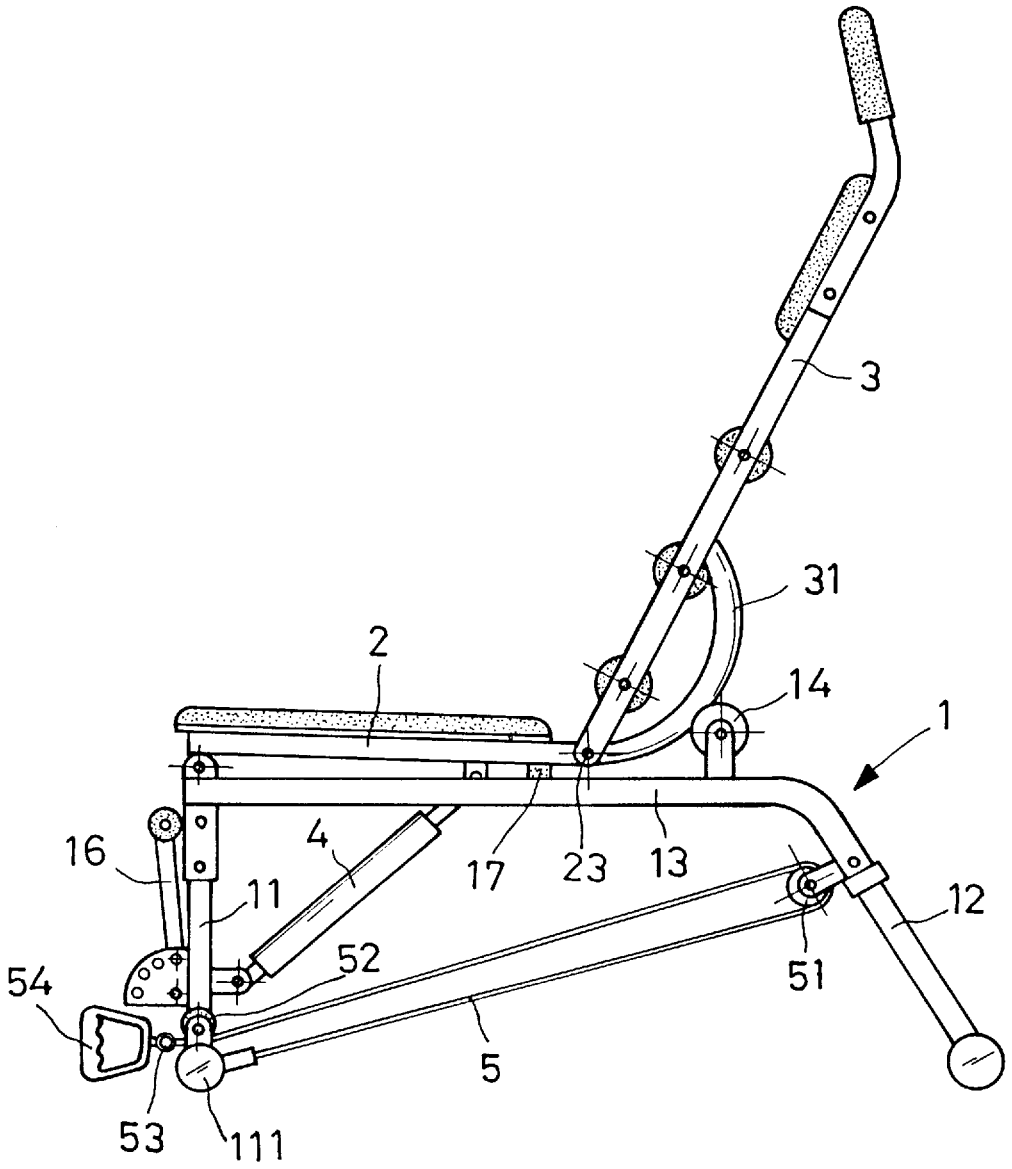
FIG. 8 is a side view of still another alternate form of the present invention, showing the elastic bands mounted on the front pulleys and the rear pulleys.
Figure 9:
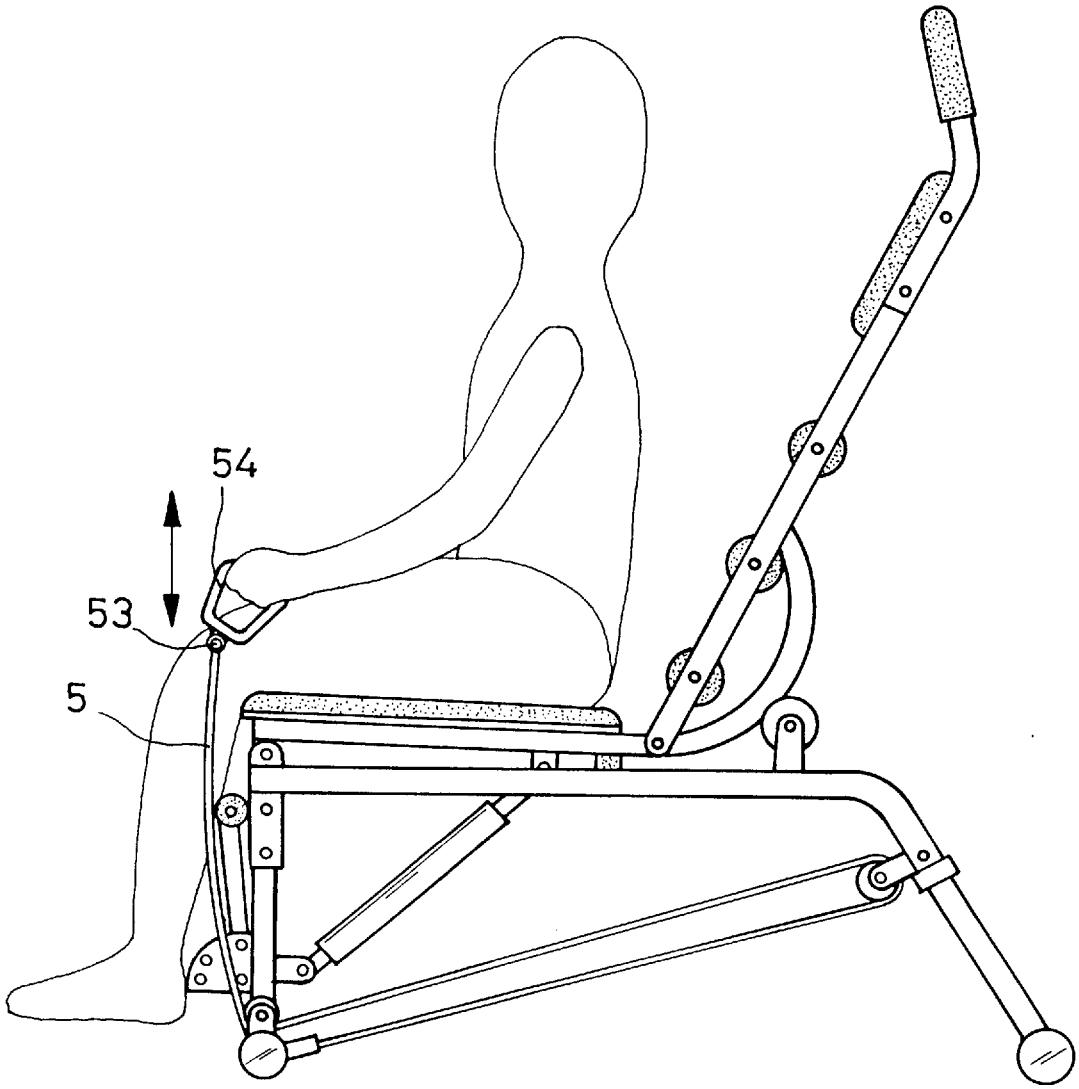
FIG. 9 is an applied view of the embodiment shown in FIG. 8.
Figure 10:
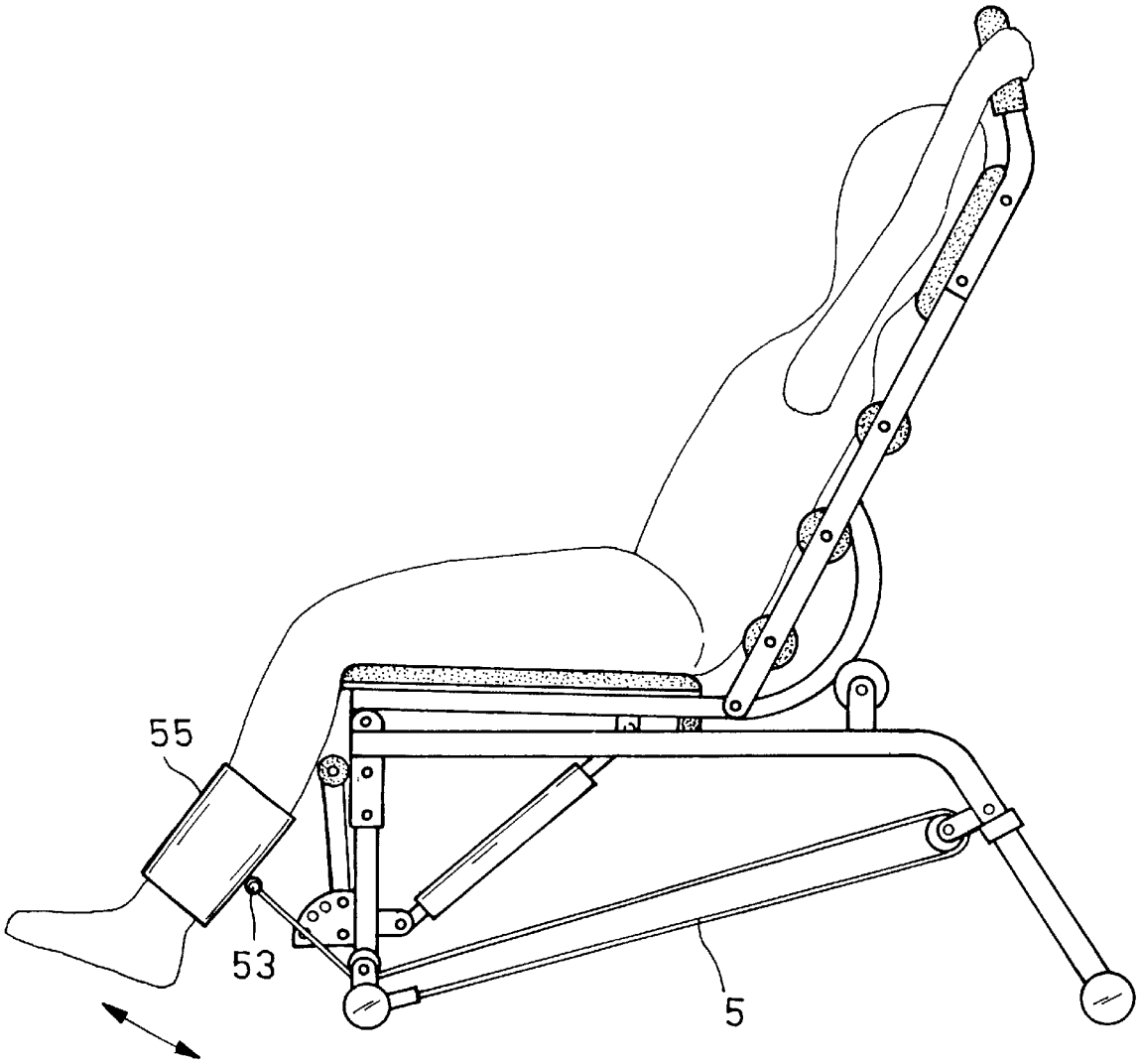
FIG. 10 is an applied view of still another alternate form of the present invention, showing the leg harnesses fastened to the user's legs.

FIGS. 8 and 9 shows still another alternate form of the present invention, in which the two elastic bands 5 are provided having a respective fixed end fixedly connected to a transverse bar 111 of the front stand 11 of the base frame unit 1, and a respective free end moved over a respective rear pulley 51 at the rear stand 12 and then turned forwards and moved over a respective front pulley 52 at the front stand 11 and then fixedly mounted with a swivel hook 53; two pull handles 54 are respectively coupled to the swivel hooks 53 of the elastic bands 5 for pulling with the hands. Alternatively, two leg harnesses 55 may be fastened to the swivel hooks 53 of the elastic bands 5 instead of the pull handles 54, so that the elastic bands 5 can be pulled with the legs (see FIG. 10).

It is to be understood that the drawings are designed for purposes of illustration only, and are not intended as a definition of the limits and scope of the invention disclosed.

What the invention claimed is:

1. A backbone stretching exerciser comprising:

a base frame unit, said base frame unit comprising a front stand, a rear stand, a horizontal top frame supported on said front stand and said rear stand, a pair of guide rollers bilaterally mounted on said horizontal top frame at a top side adjacent said rear stand, and a pair of lugs bilaterally raised from said horizontal top frame at a top side adjacent said front stand;

a seat frame unit supported on said base frame unit and holding a flexible seat for sitting, said seat frame unit having a fixed end pivoted to the lugs of said base frame unit by pivot means and a free end;

a back frame unit pivoted to said seat frame unit and adapted for supporting the user's back, said back frame comprising a bottom end pivoted to two opposite sides of the free end of said seat frame unit by pivot means, two substantially arched guide tubes bilaterally disposed at a back side thereof and respectively supported on said guide rollers of said base frame unit; and a hydraulic cylinder connected between said base frame unit and the free end of said seat frame unit to impart a damping resistance to said seat frame unit, said hydraulic cylinder having a fixed end fixedly fastened to said front stand of said base frame unit and a free end connected to the free end of said seat frame unit.

2. The backbone stretching exerciser of claim 1, wherein said base frame unit comprises a substantially T-shaped leg extension bar connected to its front stand, and cushion means mounted on said horizontal top frame and adapted to support the free end of said seat frame unit on said base frame unit.

3. The backbone stretching exerciser of claim 1, wherein said back frame unit comprises a plurality of cylindrical massaging wheels transversely disposed in parallel and adapted for massaging the user's back, and two handles bilaterally fastened to a top end thereof remote from said seat frame unit.

4. The backbone stretching exerciser of claim 1, further comprising a horizontal extension bar connected to a front side of said horizontal top frame of said base frame unit, two swinging bars respectively pivoted to said horizontal extension bar at two opposite sides, and two foot plates respectively fastened to said swinging bars at a bottom side remote from said horizontal extension bar.

5. The backbone stretching exerciser of claim 1, further comprising a transverse bar fastened to said front stand of said base frame unit, two front pulleys bilaterally fastened to said front stand of said base frame unit, two rear pulleys bilaterally fastened to said rear stand of said base frame unit, two elastic bands having a respective fixed end respectively fastened to said transverse bar, and a respective free end respectively passed over said rear pulleys and then said front pulleys and then respectively mounted with a swivel hooks, and two pull handles respectively coupled to said swivel hooks for pulling with the hands.

6. The backbone stretching exerciser of claim 1, further comprising a transverse bar fastened to said front stand of said base frame unit, two front pulleys bilaterally fastened to said front stand of said base frame unit, two rear pulleys bilaterally fastened to said rear stand of said base frame unit, two elastic bands having a respective fixed end respectively fastened to said transverse bar, and a respective free end respectively passed over said rear pulleys and then said front pulleys and then respectively mounted with a swivel hooks, and two leg harnesses respectively coupled to the swivel hooks of said elastic bands and adapted for securing to the user's legs for permitting said elastic bands to be pulled by the user's legs.

* * * * *